United States Patent [19]

Schmedes

[11] Patent Number: 4,950,501

[45] **Date of Patent: * Aug. 21, 1990**

[54] THERMAL-PRINT RIBBONS AND METHOD OF MAKING SAME

[75] Inventor: Albert Schmedes, Pattensen, Fed. Rep. of Germany

[73] Assignee: Pelikan Aktiengesellschaft, Hanover, Fed. Rep. of Germany

[ * ] Notice: The portion of the term of this patent subsequent to Apr. 11, 2006 has been disclaimed.

[21] Appl. No.: 234,969

[22] Filed: Aug. 19, 1988

[30] Foreign Application Priority Data

Aug. 22, 1987 [DE] Fed. Rep. of Germany ..... 3728076

[51] Int. Cl.[5] ..... B41M 3/12

[52] U.S. Cl. ..... 427/148; 427/146; 428/195; 428/207; 428/484; 428/488.1; 428/914; 428/913; 400/120; 400/241; 106/271

[58] Field of Search ..... 427/148, 146; 428/195, 428/207, 914, 913, 484, 488.1; 400/120, 241.1, 241; 156/234, 230; 106/271

[56] References Cited

U.S. PATENT DOCUMENTS 4,820,551 4/1989 Krauter et al. ..... 427/146
4,837,199 6/1989 Morishita et al. ..... 503/227

FOREIGN PATENT DOCUMENTS 3624602 1/1987 Fed. Rep. of Germany .
3625591 2/1987 Fed. Rep. of Germany .

*Primary Examiner*—Norman Morgenstern
*Assistant Examiner*—Roy V. King
*Attorney, Agent, or Firm*—Herbert Dubno

[57] ABSTRACT

A method of making a thermal-transfer ribbon for thermal printing in which an aqueous dispersion of the thermoplastic binder substance, a fat-soluble dyestuff and a wax or waxlike substance is formed. The dispersion is coated onto a foil or other carrier for the ribbon and water is evaporated. The coating is then subjected to a thermal treatment to melt the wax and dissolve the dyestuff therein prior to thermotransfer to a substrate.

20 Claims, No Drawings

THERMAL-PRINT RIBBONS AND METHOD OF MAKING SAME

CROSS REFERENCE TO RELATED APPLICATIONS

This application is related to the commonly owned copending application Ser. No. 015,056 filed 3 Feb. 1987, now U.S. Pat. No. 4,820,557; application Ser. No. 07/109,489 filed 15 Oct. 1987; application Ser. No. 07/152,641 filed 5 Feb. 1988 and application Ser. No. 07/154,651 filed 10 Feb. 1988.

Reference may also be had to the following commonly owned U.S. patents to which the aforementioned applications may be related in turn: U.S. Pat. No. 4,592,945 issued on 3 June 1986; U.S. Pat. No. 4,675,063 issued on 23 June 1987; U.S. Pat. No. 4,744,685 issued on 17 May 1988; U.S. Pat. No. 4,296,150 issued on 1 Apr. 1980.

This application is also related to concurrently filed copending application Ser. No. 234,970, filed Aug. 19, 1988 based on German application No. P 37 28 075.9 filed 22 Aug. 1987.

FIELD OF THE INVENTION

My present invention relates to a method of making a thermal print ribbon for use in a thermal transfer printing process and was called, from time to time, a thermocolor ribbon or a thermocarbon ribbon. The invention also relates to a thermal print ribbon as made by the improved process.

BACKGROUND OF THE INVENTION

As will be apparent inter alia from the aforementioned copending applications and the related patents, the thermal printing process generally makes use of a ribbon having a support generally in the form of a carrier foil and a melt color layer applied to the transfer side of this foil.

The ribbon is displaced between a thermal printing head and a substrate adapted to receive the print and the printing head is activated to apply a head symbol or character, e.g. an alphanumeric symbol to the reverse of the ribbon and thereby melt over a corresponding pattern the melt layer on the obverse side and transfer the melted portion to the substrate. The substrate can be a sheet of paper which can be passed between the ribbon and a platen or other support.

The print head may utilize pins and the printing apparatus can be a dot matrix printer, or the symbol can be provided on a carrier such as a wheel, band or thimble.

Printers of this type can be integrated with keyboards or numeric pads, e.g. in office machines such as typewriters and calculators. They may also serve as printers connectable to computer or word processor terminals and the like.

By and large, the carrier foil is a plastic foil or fabric, similar to those used for carbon ribbons, while the melt color or transfer layer contains a wax and/or a waxlike substance, a dyestuff or other color agent and a thermoplastic binder together optional additives.

Thermoprint ribbons of the aforedescribed type have, of course, long been known. Usually they make use of a foil-like carrier support which can be composed, for example, of paper or a synthetic resin, and a layer forming the transfer layer which constitutes the so-called melt color. The reference to a "melt color" is, naturally, merely shorthand for the statement that a fusible color layer can be melted onto a substrate to leave a portion of the fusible color layer on the substrate in the pattern of the head symbol applied to the back or reverse side of the ribbon.

It has already been mentioned that the fusible color layer will generally comprise a meltable wax-bound or synthetic resin bound dyestuff or carbon black layer.

As noted, the fusible color layer is melted by the hot printing head and a melted portion transferred to a substrate which can be a paper or foil.

The ribbons used heretofore in this manner have been termed thermotransfer or TCR ribbons, the latter acronym being short for "thermal carbon ribbon".

Thermal printers in which a hot symbol is printed in the manner described, have been the subject of German Printed Applications Nos. 2,062,494 and 2,406,613 as well as German Open Application No. 32 24 445.

In the operation of such printers, the printing head should generally be capable of developing a temperature which, at its maximum, will be about 400° C. The uncoated backside or reverse of the thermocolor ribbon, generally the reverse of the foil carrier, will come into direct contact with the printing head during the printing operation and, of course, the hot symbol.

At the instant of printing the relative speed between the thermocarbon and the paper or foil to receive the imprint is usually zero. Upon the contact of the printing symbol with the ribbon, melting of the fusible color layer and contact of the melted portion thereof with the substrate paper or foil, a pattern of the color layer corresponding to the symbol will be transferred to the substrate. Upon detachment of the ribbon from the substrate, the previously melted material in the shape of the symbol will remain adherent to the substrate and will congeal.

Apart from the thermocolor ribbons described above with simple foil-like carriers, there are also thermocolor ribbons in which the hot symbol is not formed by a thermal printing head but by resistance heating of specially formed foil-like carriers. The melt color which is also the functional layer, during this printing process, also is transferred to a substrate in the desired pattern. In the trade, such ribbons are referred to as electrothermal ribbons and the process as an electrothermal transfer process (see U.S. Pat. No. 4,309,117).

Multiuse thermal transfer ribbons, i.e. thermal transfer ribbons capable of multistrike capacity, are described for example in EP-A-0 063 000. The fusible color layer of the ribbon here is in the form of a particulate material which is insoluble in the solvent of the coating liquid and does not melt at temperatures below 100° C. The coating liquid also contains a further particulate material with a melting point between 40° and 100° C. The particulate material which does not melt at temperatures below 100° C. is preferably a metal oxide, a metal, an organic resin or carbon black. Because of this special relationship of the particulate materials, the fusible color layer is a solid mixture with a heterogeneous structure designed so that at each printing strike, only a small amount of the fusible colored material is consumed by transfer to the substrate.

The conventional methods of making the abovementioned thermocolor ribbons possess, inter alia, the significant drawback that they make use of solvents which are released into the environment and are considered contaminants of the workplace or of the environment.

German Patent Document DE-OS No. 36 26 467 describes a process for thermal transfer in which the thermocolor ribbon does not require the use of an environmentally contaminated solvent.

However, the ribbon here is only a single strike ribbon and is not designed for multistrike or multiuse capability.

OBJECTS OF THE INVENTION

It is the principal object of the present invention to provide an improved process for making a thermal-transfer ribbon for the thermotransfer of a character to a substrate upon heating of the ribbon, whereby the abovementioned disadvantages are eliminated, a multistrike capacity is achieved and the need for working with environmentally contaminating solvents is eliminated.

Another object of this invention is to extend the principals of the commonly owned copending applications and patents detailed above so that a multistrike thermal-transfer ribbon can be produced without environmental contamination.

DESCRIPTION OF THE INVENTION

These objects and others which will become apparent hereinafter are attained, in accordance with the invention in that an aqueous coating dispersion (largely free from environmentally contaminating organic solvents which must be evaporated) is formed from the thermoplastic binders, the wax or waxlike substance (forming a wax component) and a fat-soluble dyestuff in finely defined form (with other additives if desired), the dispersion being coated onto a thermocolor ribbon carrier. The aqueous component of the dispersion is evaporated and with melting of the wax or waxlike substance in a thermal treatment, a fusible color layer capable of melt transfer to a substrate in a multistrike or multiuse mode, is left on the carrier.

The method thus comprises the steps of:

(a) forming a substantially organic solventless aqueous dispersion of a fusible component consisting of at least one wax or waxlike substance, a thermoplastic binder and a fat-soluble dyestuff in finely divided form in the dispersion;

(b) coating said dispersion onto a thermotransfer side of a carrier foil;

(c) evaporating water from the dispersion coated onto said carrier foil to form a color-transfer layer from the dispersion coating on said foil; and (d) thereafter thermally treating said color transfer layer to at least partially melt said fusible component and constitute therefrom, from said thermoplastic binder and from said fat-soluble dyestuff a melt-color coating capable of thermotransfer to said substrate.

I have found, most surprisingly, considering the fact that volatile organic substances have hitherto been considered conventional for the preparation of thermocolor ribbons, that it is possible to utilize an aqueous dispersion with the required finely divided solids for coating the carrier foil if the aqueous component of the dispersion is evaporated at a temperature below the melting point of the integrated wax particles or particles of the waxlike substances and these particles are then fused or melted to form the coherent layer in a subsequent thermal treatment.

A technological clarification of the invention will be provided subsequently.

For the purpose of the invention, any desired synthetic resin (plastic) foils can be used as the carriers, where such foils have been used heretofore as the carriers of carbon ribbons for typewriters and printers heretofore and which are also capable of withstanding the high temperatures during the brief printing processes which are necessary for use of the ribbon of the invention as a thermal color ribbon. Of course, the carrier foil should also be capable, at these latter temperatures, of releasing the fusible color material. Preferred are the synthetic resin foils which are composed of thermoplastic synthetic resins having high transition temperatures.

The following materials have been found to be desirable: polyesters, especially polyethyleneterephthalate, polycarbonates, polyamides, polyvinyl compounds especially polyvinylchloride, polyvinylacetate, polyvinylalcohol and polyvinylpropionate, polyethylene, polypropylene and polystyrene.

Preferably I make use of polyethyleneterephthalate or polycarbonate as carrier foils.

Of course, the invention can be applied to fabrics coated on one or both sides with plastics. Various composite foils are fabric, paper or plastic can also be used provided, of course, they have the properties enumerated above.

It has been found to be advantageous in some cases to incorporate a plasticizer in the plastic material forming the foil to improve the flexibility of the ribbon. It is also possible to incorporate in the material constituting the ribbon, one or more substances capable of increasing the thermal conductivity of the ribbon, e.g. metal particles. The thickness of the synthetic resin foil will generally depend upon the needs, although, as a rule, the foils can be comparatively thin, e.g. with a thickness of 3 to 6 micrometers so that an optimum heat transfer can be ensured. Of course, in this range is only preferred and use can be made of thicker of thinner foils as desired.

The term "wax" is used herein in the broadest possible sense and has been defined in the commonly owned copending applications and patents dealing with thermocarbon ribbons at above as well. In general, the wax should have the following characteristics:

It should not be nonkneadable at 20° C. and should be solid to brittle-hard, coarse to fine crystalline and transparent to opaque but not glass-like.

It should be meltable at a temperature above 40° C. without decomposition and should substantially immediately above its melting point develop a comparatively lower viscosity and be nonropy.

The term "waxlike substance" and terms of similar import should be understood to refer to the materials which have been described in the commonly owned copending applications and patents and waxlike substances and to have physical and chemical characteristics largely similar to those of the waxes as defined. In carrying out the method of the invention, it has been found that the wax or waxlike substances and the wax component constituted thereof, should preferably have a melting point of at least 70° C. and no more than about 90° C.

The aqueous coating dispersion contains the aforedescribed solid particles, i.e. the thermoplastic synthetic resin, the wax or waxlike substances, the fat-soluble dyestuff and, if desired, contain additives which do not adversely effect the transverse properties, including, for example, a pigment, preferably in a particle size between 0.5 and 100 micrometers, especially between approximately 5 and 50 micrometers. This particle size range assures an especially effective product.

The aqueous coating dispersion or suspension of these materials can be made in various ways. It can be made, for example, by suspending fine solid particles of these materials or by emulsification of the melt followed by cooling, preferably with stirring under conditions which maintain the finest possible dispersion.

An important component of the fusible layer formed in accordance with the invention is the thermoplastic binder or thermoplast. Thermoplasts are generally synthetic resins or plastics which at ambient temperature are hard or even somewhat brittle and this, upon application of heat, reversibly soften and are mechanically easily deformable and at high temperatures can be transformed into the state of a viscous liquid.

Such materials pass through softening or melting stages. In accordance with the present invention, such thermoplastic synthetic resin can be used which do not melt during the final thermal treatment or maximally soften. Bearing these conditions in mind, the ordinary skilled worker in the art can readily determine which thermoplastic binders will be suitable or can be used. I prefer to use, in this connection, polystyrene, polyvinylacetate, polyvinylacetal, polyvinylchloride, polyethylene, copolymers of vinylacetate and vinylchloride, polyvinylether, polyvinylpropionate, polyvinylacrylate or ethylene/vinylacetate copolymers.

The thermoplastic binder serves, in the fusible color layer of the invention, as a matrix substance in which the wax component, dyestuff and pigment are received. To control the hardness of this matrix substance in the final melt-transfer color layer, such conventional plasticizers for the thermoplastic binder can be added as phthalic acid esters (e.g. di-2-ethylhexylphthalate, di-isononylphthalate and di-isodecyphlthalate, aliphatic dicarboxylic acid esters such as adipic acid esters like di-2-ethylhexyladipate and di-isodecyladipate, phosphates such as tricresyl phosphate and triphenyl phosphate, fatty acid esters like triethylene glycol-2-(2-ethyl butyrate) and the like. It has been found to be advantageous in some cases to incorporate stabilizers in the thermoplastic binder.

The ratio of the wax component consisting of the wax or waxlike substance, to the thermoplastic binder in the aqueous coating dispersion can vary in fairly wide range and is largely not critical for the purposes of the invention. Preferably, however, this weight ratio is about 10:1 to about 1:5 and preferably the weight ratio is about 5:1 to 1:1.

The solids content of the coating dispersion or starting dispersion can likewise vary over relatively a wide range and can be, for example, between about 20 and 80 percent by weight, although it preferably is between substantially 30 to 60 percent by weight.

It is important for the purposes of the present invention that the dyestuff which is used be soluble in the wax or waxlike substance, i.e. in the wax component. This requirement is fulfilled by the so-called fat-soluble dyestuffs. This class of dyestuffs includes azo and anthraquinone dyestuffs, for example, those marketed by Bayer A.G. under the designation "CERES-Farbstoffe". Suitable dyestuffs in this category include, from Color Index part I, the following dyestuffs: Solvent Yellow 16, Solvent Yellow 29, Solvent Yellow 14, Solvent Red 1, Solvent Red 18, Solvent Red 25, Solvent Red 24, Solvent Red 19, Smoke Dye and Solvent Blue 63, Solvent Blue 68, Solvent Green, Solvent Brown 1, Solvent Red 3, Solvent Green 3 and Solvent Black 3. This list should not be considered as limiting, since other fat-soluble dyestuffs are known in the literature and, as long as they are soluble in the wax or waxlike substance and can transfer therewith by melt-transfer on thermal printing, can be used.

Apart from such dyestuffs, the fusible layer can include pigments like carbon black, organic and/or inorganic colored pigment and so-called fillers like chalk, china clay and kaolin or alumina.

Utilizing the principles of this invention, I can make use of a dispersion which in its liquid phase consists exclusively of water and thus, upon evaporation, will not present an environmental pollution problem. In that case, the liquid phase is free from other polar solvents and/or nonpolar organic solvents. It has been found, however, that no significant problem is posed when the aqueous medium contains small amounts of such solvents, for example, small amounts of ethanol. Naturally, in the best mode embodiment of the invention the liquid phase will be free from any other solvents.

The aqueous coating dispersion can be applied in any desired manner to the carrier. For example, it can be applied by a doctor blade. The coating technique used is not critical.

Furthermore, the water can be evaporated from the coating in any desired manner, e.g. by the treatment of the coating with hot air.

Preferably, however, the temperature during the water evaporation or water reduction stage (in which the water content of the coating is reduced) which is applied is only permitted to rise to a point below that at which the wax particles or the particles of the waxlike substance are not melted or subjected to a thermal treatment which will cause them to fuse together. One can operate at temperatures close to room temperature, if desired, although the process whereby air must be passed over the coating is thereby lengthened. After the aqueous component of the coating dispersion has been evaporated or reduced in proportion sufficiently, the coating should be subjected to a thermal treatment which brings the temperature of the coating to or above the melting temperature of the wax or the waxlike substances. As a consequence, during this thermal treatment the wax or waxlike substance is melted. This thermal treatment can be carried out by any conventional heating approach, for example, by passing the ribbon over heated rolls, by contacting the coating with hot air, or by subjecting the coating to radiant heating.

The heat treatment transfers the fat-soluble dyestuff, previously present in a particulate form, into a dissolved form in the molten wax or the molten waxlike substance. When the thermocolor ribbon is used in a standard thermal printing system in especially high color rendition is achieved because of the high intensity of the color which is transferred to the substrate.

The layer thickness of the fusible color layer should be between about 5 and 30 micrometers, as a rule and preferably is 10 to 20 micrometers as the dry layer. It has been found to be advantageous in some cases to provide between the color layer and the carrier foil, an adhesion promoting layer with a thickness of about 0.1 to 5 micrometers, preferably 0.5 to 2 micrometers. Such adhesion promoting layers can be composed of conventional polymeric materials.

Specific Examples

EXAMPLE 1

An aqueous dispersion is formed by intimately mixing the following components:

| | |
|---|---|
| Ethylene-vinylacetate-Copolymer (about 40% in water) (EHAFLEX 222/AKZO Chemie) | 12 parts by weight |
| Solid Ester Wax (Loxiol G32/Henkel) | 10 parts by weight |
| Painters Clay (Colloid Clay Supreme/English China Clay Sales Co.) | 2.5 parts by weight |
| Diazo Dyestuff Solvent Black 3 (CERES Schwarz BN/BAYER AG) | 0.5 parts by weight |
| Distilled Water | 15 parts by weight |
| Silicone Defoamer (Kontrafomit/Baumheier Chem. Fabrik) | 1 part by weight |

The dispersion in an amount of 41 parts by weight is applied by a doctor blade in a coating thickness equivalent to 20 micrometers of the dried layer to a polyester support foil. By conducting hot air over the foil at a temperature of 80° C. the aqueous temperature component of the dispersion is evaporated in several minutes. The coating is then subjected to a thermal treatment at a temperature about 100° C. with heated air to melt the wax particles. The wax is then permitted to solidify and the product can be used directly as a thermotransfer ribbon with 8-strike capacity, i.e. each region can be struck 8 times in the printing process.

EXAMPLE 2

A dispersion is formed with the following composition:

| | |
|---|---|
| Ethylenevinylacetate Interpolymer (about 40% in water) (Adkote 37 R 610/Morton Chemical) | 12 parts by weight |
| Erucic Acid Amide (Loximide E/Henkel) | 6 parts by weight |
| Carbon Black (Regal 400 R/Cabot Corp.) | 2.5 parts by weight |
| Diazo-dyestuff-Solvent Red 18 (Ceresrot 3R/Bayer AG) | 0.05 parts by weight |
| Diazo-dyestuff-Solvent Black 3 (Neptun Schwarz X 60/BASF) | 0.45 parts by weight |
| Distilled Water | 28 parts by weight |

The 49 parts by weight of the dispersion is applied to a carrier of a thermal ribbon as described in Example 1 by the coating techniques there described and is dried. It is then subjected to a thermal treatment with hot air at a temperature of 100° C. to melt the waxlike substance. The thermocarbon ribbon which results has a multiuse capacity of 8 strikes. In general, it is possible utilizing the techniques described to make ribbons with a multiuse capacity of 5 to 15 overstrikes.

I claim:

1. A method of making a thermal-transfer ribbon for thermotransfer of a character to a substrate upon heating of said ribbon, said method comprising the steps of:

(a) forming a substantially organic solventless aqueous dispersion of a fusible component consisting of at least one wax or waxlike substance, a thermoplastic binder and a fat-soluble dyestuff in finely divided form in the dispersion;

(b) coating said dispersion onto a thermotransfer side of a carrier foil to form a dispersion coating;

(c) evaporating water from the dispersion coating to form a color-transfer layer on said foil; and (d) thereafter thermally treating said color transfer layer to at least partially melt said fusible component and constitute therefrom, from said thermoplastic binder and from said fat-soluble dyestuff a melt-color coating prior to thermotransfer to said substrate.

2. The method defined in claim 1 wherein the evaporation of water in step (c) is carried out at a temperature below the melting point of the fusible component.

3. The method defined in claim 2 wherein the aqueous dispersion is prepared in step (a) so as to be free from other polar and nonpolar solvents.

4. The method defined in claim 1 wherein the evaporation of water in step (c) is carried out by passing heated air over the coating formed in step (b) on said foil.

5. The method defined in claim 1 wherein said component, said thermoplastic binder and said dyestuff are present in said dispersion in a particle size of substantially 0.5 to 100 micrometers.

6. The method defined in claim 5 wherein the evaporation of water in step (c) is carried out at a temperature below the melting point of the fusible component.

7. The method defined in claim 6 wherein the aqueous dispersion is prepared in step (a) so as to be free from other polar and nonpolar solvents.

8. The method defined in claim 7 wherein the evaporation of water in step (c) is carried out by passing heated air over the coating formed in step (b) on said foil.

9. The method defined in claim 8 wherein:

said foil is a thermoplastic foil having a high glass-transition temperature and selected from the group which consists of polyesters, polycarbonates, polyamides, polyvinylchlorides, polyvinylalcohols, polyvinylpropionate, polyethylene, polypropylene and polystyrene.

10. The method defined in claim 9 wherein said foil is polyethyleneterephthalate or polycarbonate.

11. The method defined in claim 9 wherein said foil has a thickness of substantially 3 to 6 micrometers.

12. The method defined in claim 11 wherein said fusible component contains:

a wax which is nonkneadable, from solid to brittle-hard, coarse to fine crystalline and transparent to opaque but not glass-like at 20° C., melts at a temperature above 40° C. without decomposition, has low viscosity upon heating to slightly above its melting point, and remains nonropy; or a waxlike substance having physical and chemical properties similar to those of the wax.

13. The method defined in claim 12 wherein said thermo plastic binder is a thermoplastic selected from the group which consists of polystyrene, polyvinylacetate, polyvinylacetal, polyvinylchloride, polyethylene, copolymers of vinylacetate and vinylchloride, polyvinylether, polyvinylpropionate, polyacrylate and ethylene/vinylacetate copolymers.

14. The method defined in claim 13 wherein said component and said thermoplastic binder are present in said aqueous dispersion in a weight ratio between 10:1 and 1:5.

15. The method defined in claim 14 wherein said weight ratio is between 5:1 and 1:1.

16. The method defined in claim 15 wherein said dispersion is prepared in step (a) to have a solids content of substantially 20 to 80 percent by weight.

17. The method defined in claim 16 wherein said dispersion is prepared in step (a) to have a solids content of substantially 30 to 60 percent by weight.

18. The method defined in claim 17 wherein said coating in step (d) has a thickness of substantially 5 to 30 micrometers.

19. The method defined in claim 17 wherein said coating in step (d) is applied to an adhesion-promoting polymeric layer of a thickness of 0.5 to 2 micrometers, previously applied to said foil.

20. A multistrike thermotransfer ribbon as made by the method of claim 1.

* * * * *